US005504281A

United States Patent [19]

Whitney et al.

[11] Patent Number: 5,504,281

[45] Date of Patent: Apr. 2, 1996

[54] PERFORATED ACOUSTICAL ATTENUATORS

[75] Inventors: Leland R. Whitney, St. Paul; Thomas J. Scanlan, Woodbury; Charles A. Marttila, Shoreview; Joseph G. Mandell, Maplewood, all of Minn.

[73] Assignee: Minnesota Mining and Manufacturing Company, St. Paul, Minn.

[21] Appl. No.: 184,646

[22] Filed: Jan. 21, 1994

[51] Int. Cl.[6] ..... E04B 1/82

[52] U.S. Cl. ..... 181/286; 181/293; 181/199

[58] Field of Search ..... 181/286, 288, 181/293, 294, 295, 199, 284; 428/131, 304.4, 307.3, 308.4, 314.4, 315.5, 314.8, 134, 402

[56] References Cited

U.S. PATENT DOCUMENTS 3,802,163 4/1974 Riojas .
3,898,063 8/1975 Gazan .
4,109,983 8/1978 Kinoshita ..... 181/199 X
4,435,877 3/1984 Berfield .
5,108,833 4/1992 Noguchi et al. ..... 181/294 X
5,268,541 12/1993 Pettersson .
5,304,415 4/1994 Kurihara et al. ..... 181/284 X

*Primary Examiner*—Khanh Dang
*Attorney, Agent, or Firm*—Gary L. Griswold; Walter N. Kirn; Janice L. Dowdall

[57] ABSTRACT

The invention provides an acoustical attenuator comprising:

a porous material comprised of particles sintered and/or bonded together at their points of contact, having at least a portion of pores continuously connected, wherein said porous material has an interstitial porosity of about 20 to about 60 percent, an average pore diameter of about 5 to about 280 micrometers, a tortuosity of about 1.25 to about 2.5, a density of about 5 to about 60 pounds per cubic foot, a modulus of about 12,000 pounds per square inch or above, wherein said porous material has at least one through hole and wherein said interstitial porosity, average pore diameter, density and modulus values are for the porous material in the absence of any through holes, wherein the average diameter of the through hole is greater than the average pore diameter.

18 Claims, 6 Drawing Sheets

PERFORATED ACOUSTICAL ATTENUATORS

TECHNICAL FIELD

This invention involves methods of attenuating sound which use perforated acoustical attenuators, acoustical systems which incorporate such perforated acoustical attenuators, and the perforated acoustical attenuators themselves.

BACKGROUND OF THE INVENTION

The prior art teaches that acoustical barrier materials should be non-porous, massive and limp in order to be effective. A common misunderstanding is that sound absorbing materials also are good acoustical barrier materials. But, acoustical barrier materials have the opposite property from acoustical absorbing materials, i.e., barriers are highly reflective to sound, and may not absorb it. Acoustical barriers are ineffective when they are placed over an area which is not a significant noise source or path. In order to provide a noticeable improvement (3 dB reduction in sound level), the treated area must be the source or path of half the acoustical energy of the targeted noise.

U.S. Pat. No. 3,802,163, (Riojas) issued Apr. 9, 1974, discloses discs useful as filters for exhaust gases in a muffler. The discs can be steel mesh, expanded metal, asbestos, fiberglass, perforated coke, and combinations thereof. The purpose of Riojas is to reduce the impurities in automobile engine exhaust.

U.S. Pat. No. 3,898,063, (Gazan) issued Aug. 5, 1975, discloses a combined filter and muffler device having replaceable ceramic filter elements therein. The filter elements can be a molded ceramic having apertures which are cylindrical, or pie shaped, or holes that pass completely through the element. The muffler is designed such that fluids entering the filter are forced to exit out through the ceramic filter walls.

U.S. Pat. No. 4,435,877, (Berfield) issued Mar. 13, 1984, discloses a noise muffler for a vacuum cleaner constructed of flexible open cell foam inserts. Where the foam extends across the opening where working air flows, the foam has a plurality of relatively large perforations so that large particles pass through the foam barrier thus preventing plugging of the foam cells.

Holes cut into acoustical barrier materials, to provide for ventilation, structural supports, electrical wiring, control cabling, and the like, degrade the performance of the barrier. In order to regain the acoustical performance that was obtained prior to making the holes, the barrier materials may be modified by providing sealant materials to eliminate the acoustical leaks caused by the holes. Of course, when the holes are made to provide ventilation, methods other than sealing must be used to regain acoustical barrier performance. One approach is to provide additional ducts with baffles. Additionally, the baffles may be provided with sound absorbing materials.

SUMMARY OF THE INVENTION

We have discovered an attenuator comprised of a class of acoustic materials perforated with through holes showing performance that degrades surprisingly little. This class of acoustical materials is characterized by the acoustical materials' modulus, porosity, tortuosity, average pore diameter, and average density. By reducing the degree of degradation of performance due to holes being cut, the need for compensating modifications is minimized.

The acoustical attenuator of the invention comprises:

a porous material comprised of particles sintered and/or bonded together at their points of contact, having at least a portion of pores continuously connected, wherein said porous material has an interstitial porosity of about 20 to about 60 percent, an average pore diameter of about 5 to about 280 micrometers, a tortuosity of about 1.25 to about 2.5, a density of about 5 to about 60 pounds per cubic foot, a modulus of about 12,000 psi or above, wherein said porous material has at least one through hole and wherein said interstitial porosity, average pore diameter, density and modulus values are for the porous material in the absence of any through holes, wherein the average diameter of the through hole is greater than the average pore diameter.

Surprisingly the perforated acoustical attenuator of the invention provides sufficient ventilation while still providing a good level of sound attenuation.

The invention also provides a method of using an attenuator as an acoustical barrier in an ambient medium.

The invention also provides an acoustical system comprising a sound source and the attenuator. The sound source may be within an enclosure comprising the attenuator, or outside of such an enclosure.

The acoustical attenuators of the invention have a wide variety of applications including but not limited to the following: office equipment including but not limited to computers, photocopiers, and projectors; small/large appliances including but not limited to refrigerators, dust collectors, and vacuum cleaners; heating/ventilation equipment including but not limited to air conditioners; sound equipment including but not limited to loudspeaker cabinets.

The attenuator of the invention is particularly useful in applications requiring both stiffness and flexural strength sufficient to be self-supporting. In these applications, practice of the invention achieves the goals of self support, air flow, and acoustical performance through the use of only a single material.

DETAILED DESCRIPTION OF THE INVENTION

ACOUSTICAL MATERIAL

A variety of acoustical materials can be used in the attenuator of the present invention. The acoustical material is preferably an acoustical barrier material.

Figure 1A:
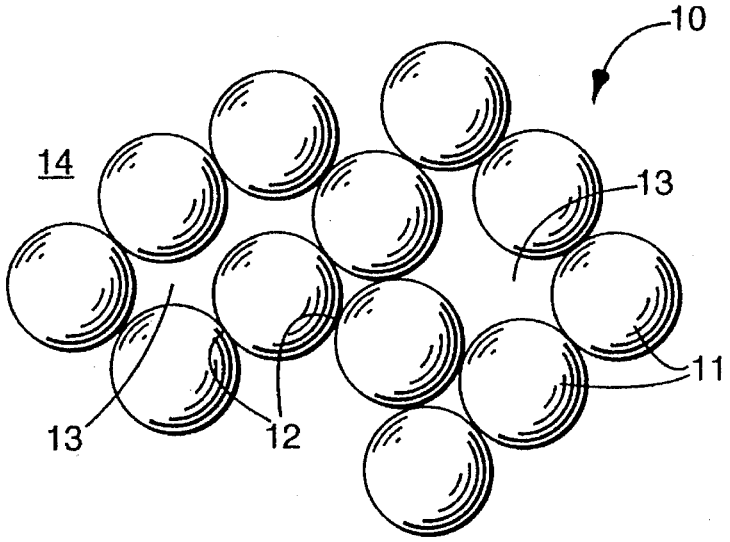
FIG. 1A is an expanded cross-sectional view of a portion of a sintered porous material useful in preparing the attenuator of the invention.
Figure 1B:
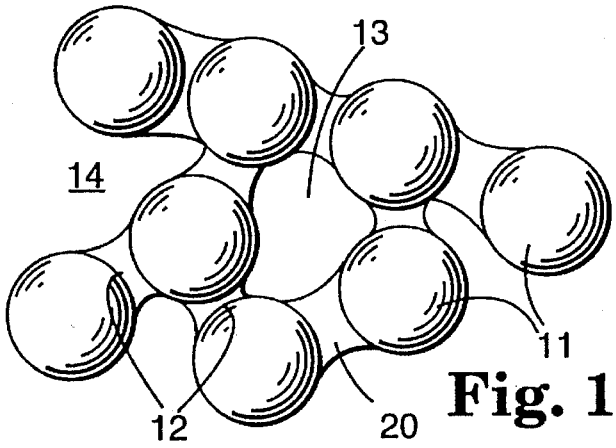
FIG. 1B is an expanded cross-sectional view of a portion of a bonded porous material useful in preparing the attenuator of the invention.

As examples, types of useful acoustical materials are shown in FIGS. 1A and 1B, as described in U.S. patent application Ser. No. 07/819,275, (Whitney et al.), incorporated herein by reference.

As shown in FIG. 1A, a particular acoustical material 10 which can be used in the attenuator of the invention comprises non-fibrous particles 11 sintered together at points of contact 12 leaving interstitial voids between particles 13, the acoustical material subsequently being provided with at least one through hole to provide the attenuator of the invention.

The acoustical material itself and the attenuator made therefrom is capable of operating within an ambient medium 14. Typically the ambient medium comprises air, but it can comprise other gases, such as hydrocarbon exhaust gases from a gasoline or diesel engine, or some mixture of air and hydrocarbon exhaust gases.

The particle 11 can made from an inorganic or polymeric material. It can be hollow or solid. An average outer diameter in the range of about 10 to about 500 microns is suitable. Hollow particles, preferred for their light weight, may have a wall thickness (difference between inner and outer average radii) of about 1–2 microns. The preferred particles have average outer diameters of approximately 20 to 100 microns, more preferably about 35 to about 85 microns, and in these preferred particles the wall thickness is not critical if it is less than the outer diameter by at least by an order of magnitude.

The material through which through holes are subsequently made is made of particles 11 which form between themselves voids 13 which have a characteristic pore diameter which may be measured by known mercury intrusion techniques or Scanning Electronic Microscopy (SEM). Results of such tests on the materials used in the practice of the invention indicate that a characteristic pore diameter of about 25 to 50 microns is preferred for applications in air.

Alternatively, and independently, the acoustical material, before the addition of through hole(s), may be characterized by a porosity of 20 to 60 percent, preferably 35 to 40 percent (in determining porosity, any hollow particles are assumed to be solid particles) as measured by known mercury intrusion techniques or water saturation methods.

Additionally, the acoustical material may be characterized by a tortuosity of about 1.25 to about 2.5 prior to the addition of the through hole(s), preferably about 1.2 to about 1.8.

For this invention, before the addition of through hole(s), an attenuation of sound by the acoustical material is comparable to mass law performance over substantially all of a frequency range of 0.1 to 10 kHz.

An example of commercially available acoustic material useful herein is the POREX(R) X-Series of porous plastic materials available from Porex Technologies Corp., Fairburn, Ga.

Examples of suitable inorganic particles include but are not limited to those selected from the group consisting of glass microbubbles, glass-ceramic particles, crystalline ceramic particles, and combinations thereof. Examples of suitable polymeric particles include but are not limited to those selected from the group consisting of polyolefin particles, such as, polyethylene, and polypropylene; polyvinylidene fluoride particles; polytetrafluoroethylene particles; polyamide particles, such as, Nylon 6; polyethersulfone particles, and combinations thereof.

Glass microbubbles are the most preferred particles 11, especially those identified by Minnesota Mining and Manufacturing Company as SCOTCHLITE™ brand glass microbubbles, type K15. These microbubbles have a density of about 0.15 g/cc.

Figure 2:
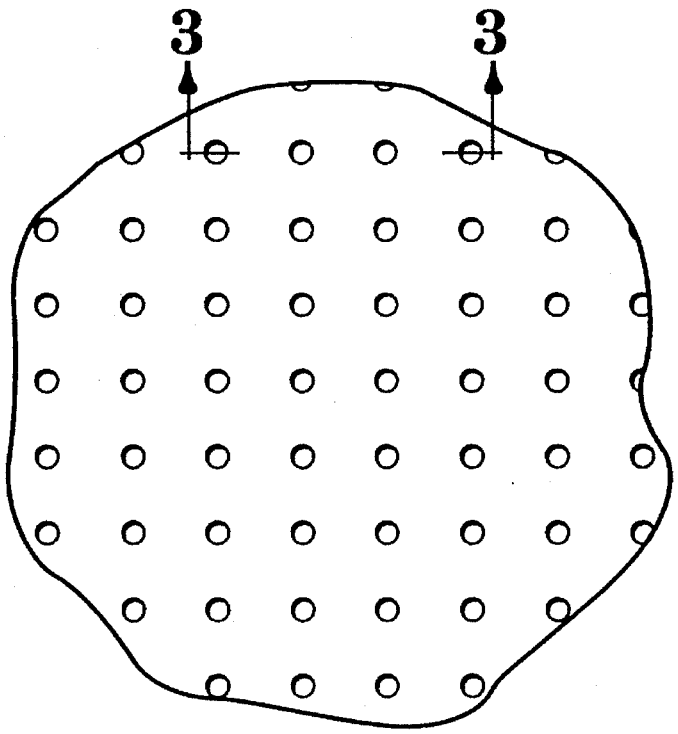
FIG. 2 is an elevational view of a portion of an attenuator of the invention.
Figure 3A:
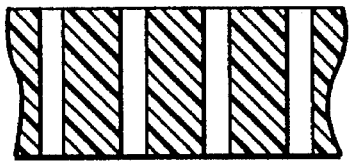
FIGS. 3 (A–H) are cross-sectional views taken along lines 3—3 of FIG. 2 of the attenuators of the invention, showing different through hole configurations.
Figure 3B:
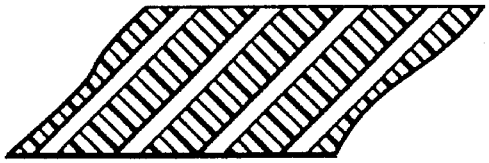
Figure 3C:
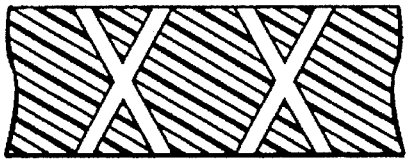
Figure 3D:
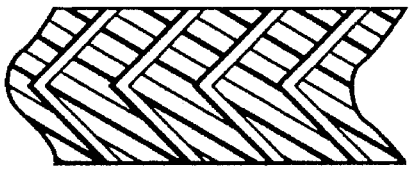
Figure 3E:
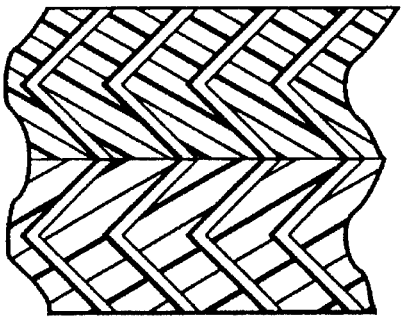
Figure 3F:
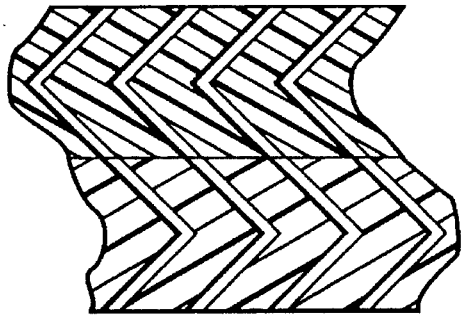
Figure 3G:
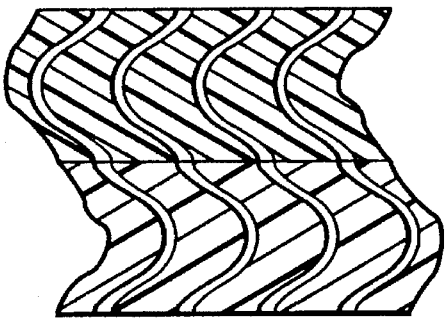
Figure 3H:
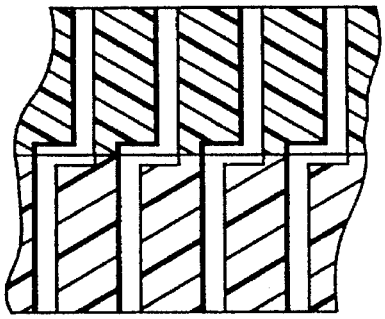
Figure 5:
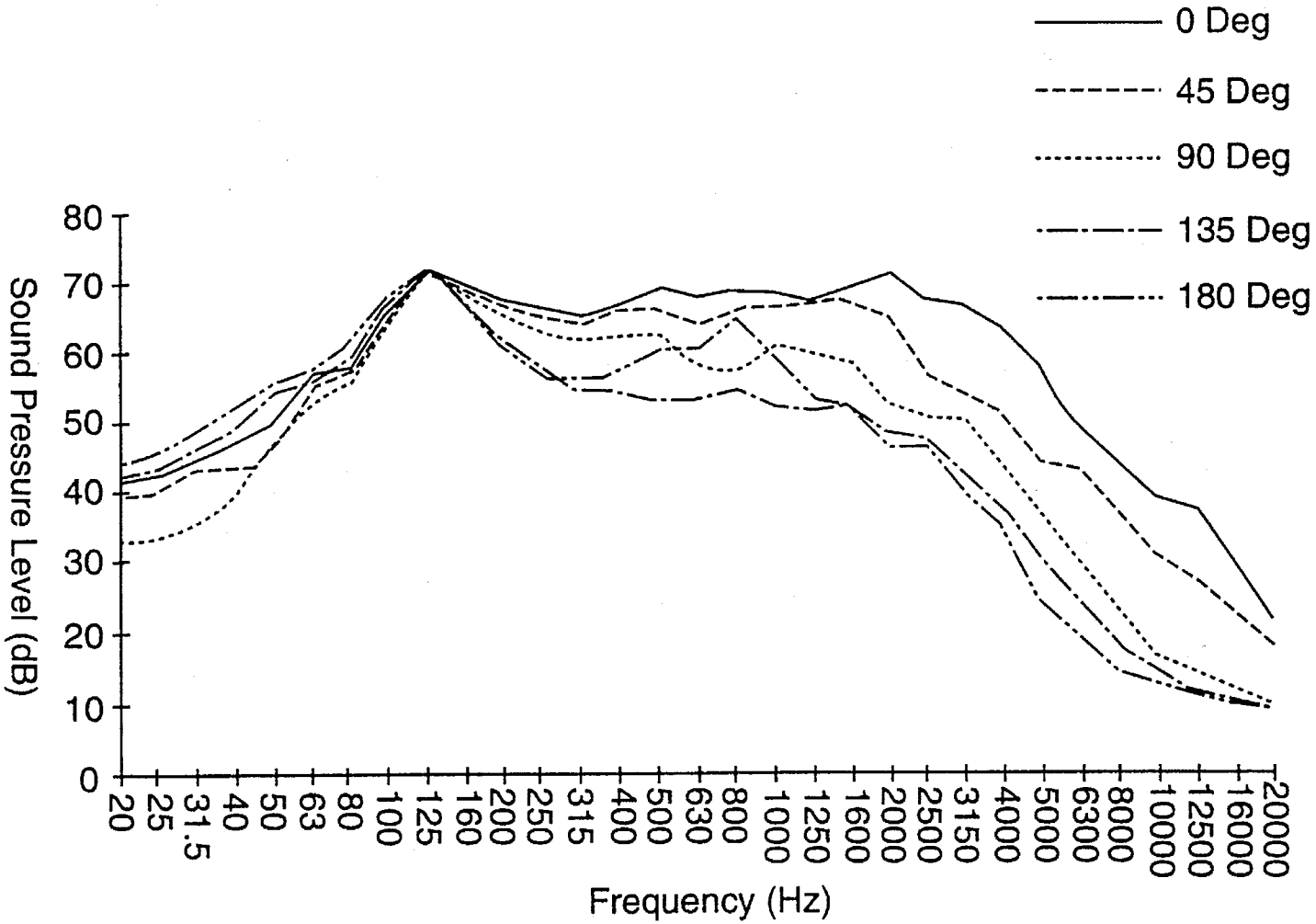
FIG. 5 is a polar plot of the loudspeaker cabinet of Example 10.
Figure 6:
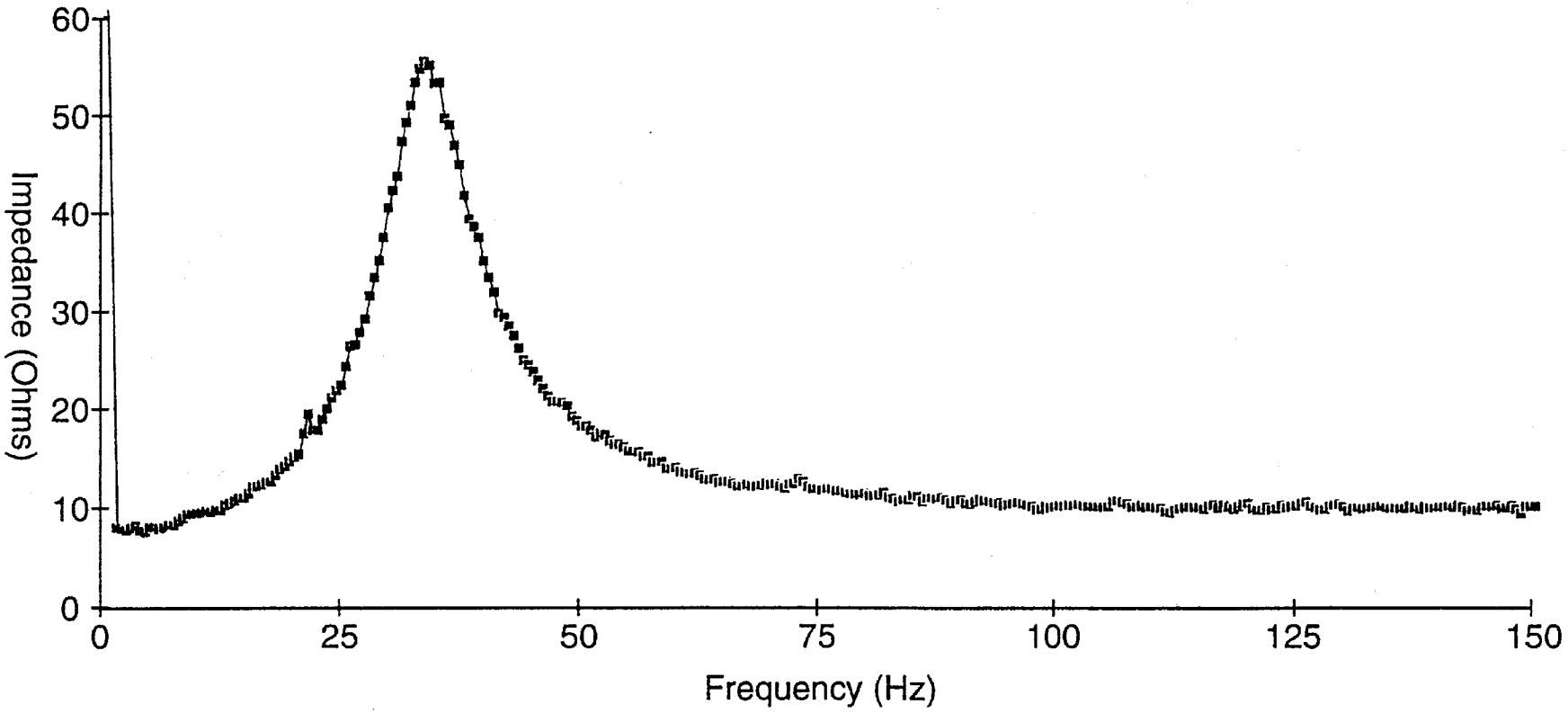
FIG. 6 is an impedance plot of the loudspeaker of Example 10 in free air.
Figure 7:
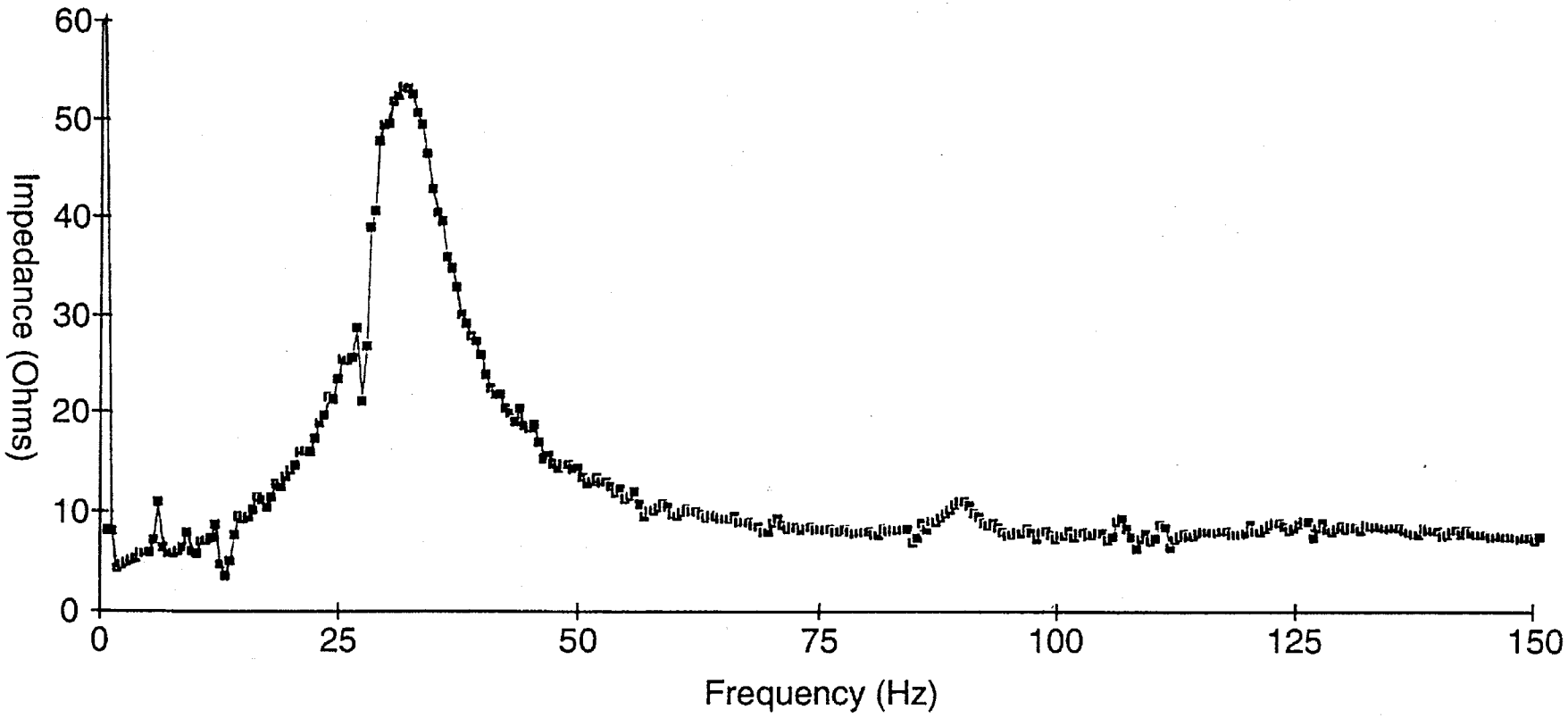
FIG. 7 is an impedance plot of the loudspeaker of Example 10 in a cabinet.

As shown in FIG. 2, an alternative to sintering is binding together the particles 11 at their contact points 12 with a separate material 20, known as a binder, but not so much binder 20 as would eliminate voids 13. Typically this may be done by mixing the particles 11 with resin of binder 20, followed by curing or setting of the resin.

If used, the binder 20 may be made from an inorganic or organic material, including ceramic, polymeric, and elastomeric materials. Ceramic binders are preferred for applications requiring exposure to high temperatures, while polymeric binders are preferred for their low density.

Alternatively the binder can be of the same material as the particles. For example, polymeric particles may be treated such that they bond to themselves with only slight deformation.

However, some polymers and elastomers may be so flexible that the acoustical material is not sufficiently stiff to perform well. Thus, the acoustical material must have a density of about 5 to about 60 lbs/cubic ft., preferably about 5 to about 40 lbs/cubic ft., and most preferably about 5 to about 15 lbs/cubic ft., and a Young's Modulus of 12,000 p.s.i. or above. If the modulus is too low sound attenuation becomes poor. Such materials will have suitable acoustical performance and also be self-supporting, making them suitable for use as structural components of enclosures.

Nonetheless, many polymeric binders are suitable, including epoxies, polyethylenes, polypropylenes, polymethylmethacrylates, urethanes, cellulose acetates and polytetrafluoroethylene (PTFE).

Suitable elastomeric binders are natural rubbers and synthetic rubbers, such as the polychloroprene rubbers known by the tradename "NEOPRENE" and those based on ethylene propylene diene monomers (EPDM).

Other suitable binders are silicone compounds available from General Electric Company under the designations RTV-11 and RTV-615.

Additionally, the acoustic barrier material described hereinabove can be further processed to form a useful barrier material as described in copending concurrently filed, U.S. patent application Ser. No. 08/185,598, Scanlan et al., "Starved Matrix Composite" incorporated by reference herein by:

(a) forming an article having a matrix microstructure with a surface available for coating from a mixture comprising ceramic particles and an organic polymer binder;

(b) pyrolyzing the article of step (a) to carbonize the binder while retaining the matrix microstructure of the article; and (c) depositing a coating selected from the group consisting of silicon carbide, silicon nitride, and combinations thereof on at least a portion of the surface of the microstructure of the article to form the acoustic material.

For this embodiment, preferably, the binder is an epoxy resin, phenolic resin, or combination thereof. The method can further include applying a second organic binder to the article prior to step (b).

The silicon carbide, silicon nitride, or combination thereof, is preferably deposited by chemical vapor deposition.

According to Scanlan et al., preferably, composite parts according to the Scanlan, et al. invention are prepared by mixing filler particles with a resin binder and other (optiona)l desired additives in a twin shell blender. After mixing for a time sufficient to blend the ingredients, the mixture is poured into a mold having a desired shape. To promote removal of the composite part from the mold, the mold is preferably treated with a release agent such as a fluorocarbon, silicone, talcum powder, or boron nitride powder. The mixture is then heated in the mold. The particular temperature of the heating step is chosen based upon the resin binder. In the case of epoxy and phenolic resins, typical temperatures are about 170° C. For large parts or parts having complex shapes, it is desirable to ramp the temperature up to the final temperature slowly to prevent thermal stresses from developing in the heated part.

According to Scanlan, et al., after heating, the composite part is removed from the mold. If desired, additional resin can be applied to the composite part (e.g., by dipping or brushing). Preferably, this resin is different from the resin in the initial mixture. For example, where the resin in the initial mixture is epoxy resin, an additional coating of phenolic resin may be applied to the composite part. The composite part is then heated again.

According to Scanlan, et al., once the part is removed from the mold, the composite part may be further shaped by machining or used as is. For example, the part can be sectioned into discs or wafers. The part can also be provided with holes or cavities. The composite part is then placed in a furnace (e.g., a laboratory furnace) provided with an inert (e.g., nitrogen) or reducing gas (e.g., hydrogen) atmosphere to pyrolyze the binder. Typically the pyrolysis is carried out at atmospheric pressure. The particular pyrolysis temperature is chosen based upon the binder. For epoxy and phenolic binders, typical pyrolysis temperatures range from 500° to 1000° C. The composite part is loaded into the furnace at room temperature and the furnace temperature then ramped up to the final pyrolysis temperature over the course of a few hours (a typical ramp cycle is about 2.3 hours).

According to Scanlan, et al., during pyrolysis, the starved matrix microstructure is preserved and the binder is converted into carbonaceous material. The carbonaceous material typically covers the surfaces of the ceramic filler particles and forms necks between adjacent particles, thereby producing a carbonaceous matrix throughout the part. This carbonaceous matrix forms part of the surface available for coating with silicon carbide or silicon nitride. It is further expected that some of the particles will have portions where no carbonaceous material is covering them due to the way in which the binder coats them and forms between them. The uncoated surface of these particles can be coated with silicon carbide and/or silicon nitride as well. Generally, however, it is preferred that at least 50% (more preferably, at least 90%) of the surface available for coating be provided with carbonaceous material.

According to Scanlan, et al., following pyrolysis, the composite part is removed from the furnace for coating with silicon carbide, silicon nitride, or combinations thereof. The coating can be formed from solution precursors such as polysilazanes dissolved in organic solvents. Moreover, in the case of silicon carbide, the coating can be formed by reaction of molten silicon metal with carbon from the carbonaceous matrix of the pyrolyzed composite part. However, it is preferred to deposit the coating by chemical vapor deposition (CVD) of gaseous precursors at reduced pressures according to techniques well-known in the art.

The acoustical material which is used in forming the attenuator of the invention may optionally further comprise one or more functional additives including but not limited to the following: pigments, fillers, fire retardants, and the like. Preferably, the material of the invention comprises sintered particles and/or bonded particles with no additives.

The material of U.S. patent application Ser. No. 07/819,275 comprises hollow microbubbles having average outer diameters of 5 to 150 micron, bound together at their contact points to form voids between themselves. The acoustical barrier material has an air flow resistivity of $0.5\times10^4$ to $4\times10^7$ mks rayl/meter, and an attenuation of sound comparable to mass law performance. Since air flow resistivity depends independently on the porosity of the material and the void volumes, the acoustical barrier material can be characterized by either a porosity of from 20 to 60 percent; or a void characteristic diameter within an order of magnitude of the viscous skin depth of the ambient medium.

The acoustical barrier material of U.S. Ser. No. 07/819,275 comprises a plurality of lightweight microbubbles, bound together at their contact points by any convenient method.

According to U.S. Ser. No. 07/819,275 preferred microbubbles are made from a ceramic or polymeric material. An average outer diameter in the range of 5 to 150 microns is suitable. Preferred microbubbles may have a wall thickness (difference between inner and outer average radii) of 1–2 microns. The preferred microbubbles have average outer diameters of approximately 70 microns, and in these preferred microbubbles the wall thickness is not critical if it is less than the outer diameter by at least by an order of magnitude.

The hollow microbubbles form between themselves voids which have a characteristic void diameter, which may be measured by known mercury intrusion techniques. Results of such tests on the materials used in U.S. Ser. No. 07/819,275 indicate that a characteristic void diameter of about 25 to 35 microns is preferred for applications in air.

According to U.S. Ser. No. 07/819,275, this range of values provides preferred acoustical performance because the characteristic void diameter approximates the viscous skin depth of the ambient medium (which depends only on the viscosity and density of the medium, and the incident frequency of the sound). For example, the viscous skin depth of air varies from 200 micron at 0.1 kHz to 70 micron at 1 kHz to 20 micron at 10 kHz.

Thus, the acoustical barrier material of U.S. Ser. No. 07/819,275 may be characterized by a characteristic void diameter within an order of magnitude of the viscous skin depth of the ambient medium; an air flow resistivity of $0.5\times10^4$ to $4\times10^7$ mks rayl/meter, preferably $7\times10^5$ mks rayl/meter; and an attenuation of sound by the material comparable to mass law performance.

Alternatively, and independently, the acoustical barrier material of U.S. Ser. No. 07/819,275 may be characterized by a porosity of 20 to 60 percent, preferably 40 percent (in determining porosity, the hollow microspheres are assumed to be solid particles); an air flow resistivity of $0.5\times10^4$ to $4\times10^7$ mks rayl/meter, preferably $7\times10^5$ mks rayl/meter; and an attenuation of sound by the material comparable to mass law performance.

For U.S. Ser. No. 07/819,275 an attenuation of sound is "comparable to mass law performance" when it is not less than 10 dBA below the theoretical performance predicted by either the field incident or normal incident mass law, over substantially all of a frequency range of 0.1 to 10 kHz, other than coincidence frequencies.

For example, the normal incident mass law predicts that the transmission loss, in decibels, is $$20 \log (\omega m/2\rho c)$$

where $\omega$ is the (angular) frequency of the incident sound, m is the mass per unit area of the acoustical barrier, $\rho$ is the density of the ambient medium, c is the speed of sound in the ambient medium.

Coincidence frequencies are those regions of the acoustical spectrum where the acoustical barrier is mechanically resonating such that the acoustical impedance of the barrier as a whole is equal to that of the ambient medium, i.e., perfect transmission will occur for waves incident at certain angles. Such frequencies are determined only by the thickness and mechanical properties of the acoustical barrier.

For U.S. Ser. No. 07/819,275 glass microbubbles are the most preferred lightweight microbubbles, especially those identified by Minnesota Mining and Manufacturing Company as "SCOTCHLITE" brand glass microbubbles, type C15/250. These microbubbles have density of about 0.15 g/cc. Screening techniques to reduce the size distribution and density of these microbubbles are not required, as they have only minimal effect on acoustical performance (in accordance with mass law predictions).

According to U.S. Ser. No. 07/819,275, an alternative to sintering is binding together the microbubbles at their contact points with a separate material, known as a binder, but not so much binder as would eliminate voids. Typically this may be done by mixing the microbubbles with resin of binder, followed by curing or setting.

If used, the binder may be made from an inorganic or organic material, including ceramic, polymeric, and elastomeric materials. Ceramic binders are preferred for applications requiring exposure to high temperatures, while polymeric binders are preferred for their flexibility and lightness.

According to U.S. Ser. No. 07/819,275, some polymers and elastomers may be so flexible that the acoustical barrier is not sufficiently stiff to perform well. Preferably, the acoustical barrier is additionally characterized by a specific stiffness of 1 to $8\times10^6$ psi/lb-in$^3$, and a flexural strength of 200 to 500 psi as measured by ASTM Standard C293-79. Such barriers will have suitable acoustical performance and also be self-supporting, making them suitable for use as structural components of enclosures.

According to U.S. Ser. No. 07/819,275, many polymeric binders are suitable, including epoxies, polyethylenes, polypropylenes, polymethylmethacrylates, urethanes, cellulose acetates and polytetrafluoroethylene (PTFE). Suitable elastomeric binders are natural rubbers and synthetic rubbers, such as the polychloroprene rubbers known by the tradename "NEOPRENE" and those based on ethylene propylene diene monomers (EPDM). Other suitable binders are silicone compounds available from General Electric Company under the designations RTV-11 and RTV-615.

BARRIER MATERIAL I OF U.S. SER. NO. 07/819,275

To manufacture the acoustical barrier material, Minnesota Mining and Manufacturing Company "SCOTCHLITE" brand glass microbubbles, type C15/250, having density of about 0.15 g/cc and diameters of about 50 micron were mixed with dry powdered resin of Minnesota Mining and Manufacturing Company "SCOTCHCAST" brand epoxy, type 265, in weight ratios of resin to microbubbles of 1:1, 2:1 and 3:1. The microbubbles were not screened for the 1:1 and 3:1 mixtures, but both screened and unscreened microbubbles were used in 2:1 mixtures. The resulting powder was sifted into a wood or metal mold and cured at 170° C. for about an hour.

The cured material had a density of about 0.2 g/cc. The void characteristic diameter was about 35 micron. The air flow resistivity was $10^6$ mks rayl/meter, and porosity was about 40% by volume; each of these values is approximately that of packed quarry dust as reported in the literature. The flexural strength ranged up to 500 psi depending on resin to bubble ratio. The composite did not support a flame in horizontal sample flame tests.

Three types of acoustical characterization were performed on the material.

First, impedance tube measurements determined the sound attenuation of the material in dB/cm. The results of these measurements are independent of sample geometry (shape, size, thickness). Three types of samples were measured and compared to 0.168 g/cc and 0.0097 g/cc "FIBERGLASS" brand spun glass thermal insulation (Baranek, Leo L., *Noise Reduction,* McGraw-Hill, New York, 1960, page 270), and also to packed quarry dust (Attenborough, K., "*Acoustical Characteristics of Rigid Fibrous Absorbents and Granular Materials," Journal of the Acoustical Society of America,* 73(3) (March 1983), page 785).

The acoustical attenuation of a sample prepared with a 1:1 weight ratio of resin to hollow microbubbles was between 0.1 and 10 dB/cm over a frequency range of 0.1 to 1 kHz, comparable to the attenuation of each of the other three materials (roughly 0.3 to 5 dB/cm).

The attenuation for a sample prepared with a 2:1 weight ratio of resin to unscreened hollow microbubbles was between 0 and 12 dB/cm over the same frequency range, while the other three materials showed attenuations of 0–3 dB/cm over the same range. For a 2:1 weight ratio using screened hollow microbubbles, the attenuation decreased somewhat in the 0.2 to 0.4 kHz range, but rapidly increased to over 14 dB at 1 kHz.

Second, insertion loss measurements according to SAE J1400 were made using panels inserted in a window between a reverberant room containing a broadband noise source and an anechoic box containing a microphone. The panel sizes were 55.2 cm square and up to 10.2 cm thick. These results are strongly dependent upon geometry.

The acoustical barrier panels comprising hollow microbubbles were about 10.2 cm thick and had mass of about 19.8 kg. By comparison, gypsum panels of 1.59 cm thickness (common in the building industry) had mass of about 16.3 kg. A lead panel had mass of 55 kg.

Over the 0.1 to 10 kHz frequency range, the panel comprising microbubbles performed somewhat better than the gypsum panel. In particular, at 160 Hz, the insertion loss through the panel comprising microbubbles was 10 dB greater than that through the lead panel, despite having only 36 percent of the mass.

As compared to theoretical performance, the panel comprising microbubbles exceeded mass law predictions except: between about 0.25 kHz and about 0.4 kHz, but by less than 10 dB throughout the range; at 0.8 kHz, but again by less than 10 dB; and from about 3 kHz to 10 kHz, but this is due to a coincidence frequency range centered about 6 kHz.

Third, insertion loss measurements were made with boxes containing a broadband noise source, using a microphone and a frequency analyzer. The roughly cube-shaped boxes ranged in size from 41 to 61 cm on a side. These results are strongly dependent upon geometry.

A box made from the acoustical barrier material comprising microbubbles and a box made from gypsum were constructed so that each had the same total mass, about 52.8 kg, despite different wall thicknesses. Thus, the box made from material comprising microbubbles had walls about 10.2 cm in thickness, and the box comprising gypsum had walls about 1.6 cm in thickness.

The attenuation by the box made from the acoustical barrier material comprising microbubbles exceeded mass law performance over the entire frequency range from 0.04 kHz to 1 kHz, and was no less than 10 dB less than mass law performance over substantially all of the frequency range of 1 kHz to 8 kHz.

Below 1 kHz and above 2 kHz, the box made from the acoustical barrier material comprising microbubbles performed generally about 10 dB better than the box made from gypsum.

BARRIER MATERIAL II OF U.S. SER. NO. 07/819,275

A piece of acoustical barrier material was manufactured as described in Barrier Material I of U.S. Ser. No. 07/819,275 from "SCOTCHCAST" brand epoxy resin type 265 and "SCOTCHLITE" type C15/250 glass microbubbles, blended in weight ratios ranging from 2:1 to 1:1 and thermally cured to form rigid structures ranging from about 4.8 mm to 15.9 mm in thickness. Several 3.5 cm diameter cylinders of material were cut and shaped such that the cylinders fit snugly into the muffler housing of a "GAST" air motor, model number 2AM-NCC-16, which had approximately the same inner diameter as the outer diameter of the cylinder. The cylinder replaced a conventional muffler, namely two #8 mesh screens supporting between themselves a dense non-woven fiber of about 13 cm thickness.

THROUGH HOLE(S)

As indicated previously, the attenuator of the invention comprises an acoustical material having one or more through holes. By "through holes" is meant openings traversing the acoustical material such that the through holes are capable of connecting high pressure and low pressure surfaces (when there is flow of ambient medium) and/or are capable of connecting high sound intensity and lower sound intensity surfaces of the acoustical material. The number and size of the through holes can vary. Typically, sufficient through holes are present to provide the desired air flow rate for a particular use, such as ventilation. Moreover, sufficient through holes are present such that about 0.10 to about 90 percent of the total acoustical material surface area (without through holes) contains through holes. If less than 0.1 percent of the total acoustical material surface area (without through holes) contains through holes the flow characteristics approach that of the acoustical barrier material without holes. If greater than 90 percent of the total acoustical material surface area (without through holes) contains through holes the structural integrity of the material can be compromised and acoustical benefits are negligible. Preferably, the total acoustical material surface area (without through holes) contains about 0.5 to about 50 percent through holes for reasons of maximizing air flow and sound attenuation, most preferably about 0.9 to about 25 percent for reasons of ease of manufacturing and to further maximize sound performance.

The acoustical material can contain any number of through holes. However, the total percentage area covered by the through holes may be held constant by varying the hole diameter. If only several through holes are present which have very large diameters, the sound attenuation may be diminished. If a very large number of through holes are present which have small diameters the back pressure may rise appreciably when compared to the case of a few larger holes. Typically, a sufficient number of through holes having a sufficient diameter is selected such that the air flow and sound attenuation is good for a particular application. This invention provides an unexpectedly broad range of flexibility to achieve these sound and back pressure targets when compared with non-porous perforated substrates. Preferential attenuation of high frequency sound was unexpectedly attained with an increasing number of through holes as demonstrated by Example 9 in samples greater than or equal to 4 inches in thickness.

The diameter of the through hole(s) is application dependent and can range from just greater then about the average pore diameter of the acoustical material to much greater than the thickness of the attenuator, subject to the other limitations disclosed hereinabove. For a large number of applications, the diameter of the through hole(s) range from about 1/64 inch to about 6 inches, typically, from about 1/16 inch to about 2 inches. If the diameter of the through hole is less than about 1/64 inch the back pressure may increase greatly. The through holes need not be all the same diameter. Typically, the through holes are all of the same diameter for ease of machining.

The length of the through hole is typically the same as the thickness of the acoustical material although it can differ if the through hole is not both straight and perpendicular through the material. It is foreseeable that the paths of the through holes may be other than straight (twisted or curved for example). It is believed that such through holes would result in a material that also functions well for its intended purpose. This is particularly useful when application design limits the barrier material thickness. The length of the through hole depends upon the intended application of the acoustical material as well as the thickness of the acoustical material. It has been observed that when the hole length is about ½" or greater pressure drop through attenuators comprising porous barrier materials is lower than for non-porous substitutes. If the hole length is less than about ½", resistance to ambient flow through the attenuator approaches that of a nonporous material provided with similar through holes.

The ratio of hole length to diameter can vary depending upon the attenuator application. Typically, however, the length to diameter ranges from about 1:1 to about 100:1 for reasons of good air flow and sound attenuation. If the length to diameter ratio is greater than about 100:1, back pressure may substantially increase. If the length to diameter ratio is less than about 1:1, sound attenuation may diminish.

The shape of the through holes can vary. The through hole can take a variety of shapes including but not limited to the following: circular, elliptical, square, slits, triangular, rectangular, etc. and combinations thereof. Typically, the holes are circular for ease of machining. A cross section of the hole may vary but is typically constant also for ease of machining.

The pattern of the through holes can vary. The pattern can be symmetrical or asymmetrical. It is preferable that the through holes be relatively evenly distributed for reasons of uniform air flow. If the through holes are all concentrated in one location of the material structural integrity may be compromised. In some circumstances it is desirable to concentrate the through holes in one location in the material; in its intended use the attenuator will only receive incident air at that location. In that portion of the attenuator it is best that the through holes are uniformly distributed.

Another aspect of the invention is an acoustical system comprising a source of sound, radiating in the direction of the acoustical attenuator. In a typical acoustical system, it is sufficient to simply place the acoustical attenuator between the sound source and the listener, but for additional attenuation of sound, the acoustical attenuator substantially (or even completely) surrounds either the sound source or the ear of the listener.

Figure 4:
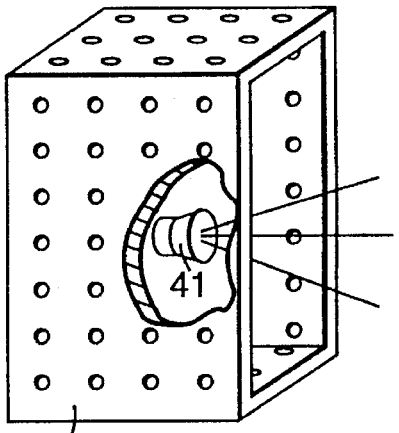
FIG. 4 is a schematic perspective view of an acoustical system employing the attenuator of the invention.

For example, as shown in FIG. 4, an open box 40 (such as an open-faced enclosure for a loudspeaker 41) could be constructed using the acoustical attenuator.

Another application would be headphones having ear enclosures constructed from the acoustical attenuator, since the ear enclosures would "breathe" in a passive manner, and thus provide improved comfort for the listener.

In many applications, such a system can be acoustically sealed, relying on the porosity of the acoustical attenuator itself to allow air and moisture to escape from the enclosure directly through the attenuator.

Thus, for example, a sealed noise reduction enclosure could be provided for a piece of machinery mounted on a base. The acoustical attenuator could be partially lined with acoustical absorbing material.

Muffler Applications

One particularly preferred acoustical system utilizes the acoustical attenuator as a muffler. In this application, the acoustical attenuator has allowed gasses to readily pass through the muffler.

Structural Applications

It is possible to use the acoustical attenuator described above without a separate supporting assembly, i.e., as a structural component. Large volume enclosures may be made from panels, blocks, or sheets of attenuator.

Such panels are formed so that each panel has a portion of an interlocking joint. Such interlocking panels are especially useful in forming acoustically sealed enclosures.

TEST METHODS

The following test methods were used to measure the various test results reported in the examples.

Back Pressure and Sound Pressure Level

Back pressure and sound pressure level of a sample were tested at various flow rates on a laboratory flow bench. A sample holder in the shape of a box was connected to a laboratory pressurized air line by means of metal tubing at one face or end of the box and the sample to be tested was affixed to the opposite end of box. A 12 inch by 12 inch surface area of the sample was exposed to the incoming air. The temperature of the inlet air was measured with a thermometer. A gauge pressure sensor was placed in line between the air inlet and the sample to measure the build-up of back pressure from the sample.

Measurement of sound pressure level (i.e., noise level) was accomplished by means of a Bruel and Kjaer Dual-Channel Portable Signal Analyzer Type 2148 (commercially available from Bruel and Kjaer, Naerum, Denmark) positioned 1 meter from the center of the sample surface at an angle of 45 degrees from the direction of the sound source. Each measurement was the result of a single reading point. The air flow rate was set at the desired level and once the air flow rate level was stable, the sound pressure level reading was taken. The units of measurement were in dBA, which refers to an A-weighted decibel scale.

Back pressure (measured in inches of $H_2O$) was the pressure difference across the sample (i.e., the pressure at the inlet minus the pressure at the outlet). Flow was measured in standard cubic feet per minute (scfm). Low values of back pressure and sound pressure level are desirable.

Young's Modulus

Young's Modulus for each sample was calculated (roughly according to ASTM C 623) as follows:

The weight and dimensions of the sample were measured and used to calculate the density of the sample. Care was taken to assure that the measured frequency corresponded to the first bending mode. An accelerometer and an instrumented impact hammer were connected to a frequency analyzer to measure frequency response function of various points on the sample. The frequency response function was analyzed using the modal analysis program "Star Modal", Version 4, commercially available from GenRaid/SMS Inc., Milpitas, Calif., to determine natural frequency and modal shapes of the sample. A numerical analysis (finite element modelling) was performed to calculate the theoretical first bending mode. The measured dimensions and density values were input to the model, and a value for Young's modulus was assumed. The theoretical first bending frequency from the finite element model was compared to the actual first bending mode from the measurement. The purpose of this step is to determine how to adjust the initial Young's modulus value; if the theoretical frequency was below the actual measured frequency, Young's modulus was increased, and vice versa. The above step was repeated until the theoretical first bending frequency from the finite element model agreed with the actual first bending mode from the measurement. Young's modulus was the latest or last value used in the finite element model and is reported in pounds per square inch (psi).

ABBREVIATIONS

The following abbreviations are used herein:

| Abbreviation | Definition |
|---|---|
| SPL | Sound Pressure Level |
| BP | Back Pressure |
| AFR | Air Flow Rate |
| DEG | Degrees (angular) |
| Dia. | Diameter |
| dBA | A-weighted decibel |
| scfm | Standard cubic feet per minute |
| L/D | Length of hole/diameter of hole |
| Wall Surface Area = pi × diameter of hole × number of holes × length of holes | |

EXAMPLES

This invention is further illustrated by the following representative Examples, but the particular materials and amounts thereof recited in these Examples, as well as other conditions and details, should not be construed to limit this invention. All parts and percentages are by weight unless otherwise indicated.

EXAMPLE 1

In this Example, the benefit of the through holes coupled with the acoustical barrier material porosity is demonstrated.

Two samples of the acoustical material of this example were prepared as follows: Minnesota Mining and Manufacturing Company SCOTCHLITE™ brand glass microbubbles, type K15, having a density of about 0.15 g/cc and diameters of about 50 microns were mixed with dry powdered resin of Minnesota Mining and Manufacturing Company SCOTCHCAST™ brand epoxy, type 265, in weight ratios of resin to microbubbles of 2:1. The resulting powder was sifted into a mold, vibrated by mechanical means to settle the loose powder and facilitate the release of any trapped air, and cured at 170° C. for up to about 4 hours depending on the block size. The cured blocks were then cut if necessary to the desired test size and thickness.

The cured material would have a density of about 0.2 g/cc based on historical measurements. The pore characteristic diameter would be about 35 microns. The porosity would be about 40% by volume. The Young's modulus was about 60,000 pounds per square inch. This material was designated as "ACM-1". One of the thus prepared samples was further treated by coating one of its faces with a two-part liquid epoxy such that the surface was sealed and the surface pores were filled in. Next, 265 through holes of ⅛ inch diameter were drilled perpendicular to the major attenuator surface in an evenly spaced square array pattern (grid pattern) over the 12 inch by 12 inch face of the each sample. The sample thickness was 2 inches. In this Example, hole length was equivalent to the sample thickness. The samples were then tested for sound pressure level back pressure according to the test methods outlined hereinabove.

The sound pressure level (SPL) in dBA, the back pressure (BP) in inches of water, and the air flow rate (AFR) in scfm are reported in Table 1 below.

TABLE I

Epoxy Coated Vs. Uncoated ACM

| Flow | Uncoated Attenuator 265⅛" Dia. Holes | | Epoxy Coated Attenuator 265⅛" Dia. Holes | |
|---|---|---|---|---|
| Rate (scfm) | Pressure (Inches of $H_2O$) | SPL (dBA) | Pressure (Inches of $H_2O$) | SPL (dBA) |
| 5 | 0 | 5.0 | 0 | 5.1 |
| 10 | 0 | 54.4 | 0.1 | 55.2 |
| 15 | 0.1 | 56.8 | 0.1 | 57.7 |
| 20 | 0.1 | 58.1 | 0.2 | 59.3 |
| 25 | 0.2 | 60 | 0.3 | 61.6 |
| 30 | 0.2 | 62.3 | 0.4 | 63.4 |
| 35 | 0.3 | 63.5 | 0.5 | 64.9 |
| 40 | 0.4 | 65.2 | 0.5 | 66.3 |
| 45 | 0.4 | 66.5 | 0.7 | 67.7 |
| 50 | 0.5 | 67.7 | 0.8 | 68.4 |
| 55 | 0.6 | 69.1 | 1 | 70.2 |
| 60 | 0.7 | 70.1 | 1.1 | 71.2 |
| 65 | 0.8 | 71.8 | 1.3 | 72.4 |
| 70 | 0.9 | 73 | 1.5 | 74 |
| 75 | 1.1 | 74.5 | 1.7 | 75.3 |
| 80 | 1.2 | 75.4 | 1.9 | 76.2 |
| 85 | 1.4 | 76.4 | 2.1 | 77 |
| 90 | 1.5 | 77.4 | 2.4 | 78.1 |
| 95 | 1.7 | 78.5 | 2.7 | 78.9 |

It can be seen from the data that the porosity of the barrier material reduces the pressure drop and produces better sound attenuation.

EXAMPLES 2–3

These Examples show the effect of varying the through hole number, length to diameter ratio, and wall surface area while holding the percent open area and sample thickness constant.

The barrier material used in these Examples was ACM-1 prepared according to Example 1 above. A plurality of through holes was drilled in the samples in the same pattern as Example 1 and the samples were tested as in Example 1. Example 2 had a percent open area of 1.23%. Example 3 had a percent open area of 2.26%.

The number of through hole(s), diameter (D) of through holes, AFR, SPL, and BP are given in Table II below.

TABLE II

| | 1 Hole 1½" Dia. 2" Thick | | 4 Holes ¾" Dia. 2" Thick | |
|---|---|---|---|---|
| Flow Rate (scfm) | Pressure (Inches of $H_2O$) | SPL (dBA) | Pressure (Inches of $H_2O$) | SPL (dBA) |
| 5 | 0 | 56.3 | 0 | 54.2 |
| 10 | 0 | 62.5 | 0.1 | 62.6 |
| 15 | 0.1 | 67.3 | 0.1 | 62.8 |
| 20 | 0.2 | 69.2 | 0.2 | 63.8 |
| 25 | 0.3 | 70.7 | 0.4 | 67.9 |
| 30 | 0.4 | 72.2 | 0.5 | 68.6 |
| 35 | 0.5 | 73.3 | 0.6 | 69.8 |
| 40 | 0.7 | 74.9 | 0.8 | 71.2 |
| 45 | 0.9 | 76 | 1.1 | 72.4 |
| 50 | 1.1 | 76.7 | 1.3 | 73.2 |
| 55 | 1.3 | 77.9 | 1.6 | 74.6 |
| 60 | 1.5 | 78.5 | 1.8 | 75.4 |
| 65 | 1.8 | 79.9 | 2.1 | 76.9 |
| 70 | 2.1 | 81 | 2.5 | 78.5 |
| 75 | 2.4 | 82.7 | 2.8 | 79.3 |
| 80 | 2.7 | 83.3 | 3.2 | 80.3 |
| 85 | 3 | 84.2 | 3.6 | 81.3 |
| 90 | 3.4 | 85 | 3.9 | 81.9 |
| 95 | 3.8 | 86.3 | 4.4 | 82.8 |

| | 36 Holes ¼" Dia. 2" Thick | | 64 Holes 3/16" Dia. 2" Thick | | 144 Holes ⅛" Dia. 2" Thick | |
|---|---|---|---|---|---|---|
| Flow Rate (scfm) | Pressure (Inches of $H_2O$) | SPL (dBA) | Pressure (Inches of $H_2O$) | SPL (dBA) | Pressure (Inches of $H_2O$) | SPL (dBA) |
| 5 | 0 | 51 | 0 | 49.4 | 0.1 | 50.3 |
| 10 | 0.1 | 55.9 | 0.1 | 54.9 | 0.1 | 53.3 |
| 15 | 0.1 | 57.2 | 0.2 | 56 | 0.2 | 54.7 |
| 20 | 0.2 | 57.8 | 0.3 | 56.8 | 0.4 | 55.8 |
| 25 | 0.4 | 61.1 | 0.4 | 58.8 | 0.6 | 57.2 |
| 30 | 0.5 | 62.9 | 0.6 | 60.3 | 0.7 | 59.1 |
| 35 | 0.7 | 63.9 | 0.8 | 62.1 | 1 | 60.9 |
| 40 | 0.9 | 65.5 | 1 | 63.5 | 1.3 | 62.4 |
| 45 | 1.1 | 66.7 | 1.3 | 65.3 | 1.6 | 63.7 |
| 50 | 1.4 | 67.5 | 1.6 | 66.3 | 2 | 65 |
| 55 | 1.4 | 67.4 | 1.9 | 67.9 | 2.5 | 66.7 |
| 60 | 2 | 70.2 | 2.2 | 69.1 | 2.9 | 67.9 |
| 65 | 2.3 | 71.2 | 2.5 | 70.2 | 3.4 | 69.1 |
| 70 | 2.6 | 72.6 | 2.9 | 71.5 | 4 | 70.4 |
| 75 | 3.1 | 74.2 | 3.3 | 72.6 | 4.6 | 71.6 |
| 80 | 3.4 | 74.6 | 3.7 | 73.9 | 5.1 | 72.7 |
| 85 | 3.8 | 75.9 | 4.1 | 74.6 | 5.7 | 73.6 |
| 90 | 4.3 | 77.1 | 4.5 | 75.6 | 6.4 | 74.5 |
| 95 | 4.8 | 77.8 | 5.1 | 77 | 7.2 | 75.7 |

Example 3

Same Thickness Same % Open Area Varied L/D

| | 265 Holes ⅛" Dia. 2" Thick | | 170 Holes 5/32" Dia 2" Thick | |
|---|---|---|---|---|
| Flow Rate (scfm) | Pressure (Inches of $H_2O$) | SPL (dBA) | Pressure (Inches of $H_2O$) | SPL (dBA) |
| 5 | 0 | 50 | 0 | 50.7 |
| 10 | 0 | 54.4 | 0 | 55.2 |
| 15 | 0.1 | 56.9 | 0.1 | 57.2 |
| 20 | 0.1 | 58.1 | 0.1 | 58.8 |
| 25 | 0.2 | 60 | 0.2 | 61.1 |
| 30 | 0.2 | 62.3 | 0.2 | 62.8 |
| 35 | 0.3 | 63.5 | 0.3 | 64.2 |

TABLE II-continued

| | | | | |
|---|---|---|---|---|
| 40 | 0.4 | 65.2 | 0.3 | 66.1 |
| 45 | 0.4 | 66.5 | 0.4 | 67.5 |
| 50 | 0.5 | 67.7 | 0.4 | 68.5 |
| 55 | 0.6 | 69.1 | 0.5 | 69.7 |
| 60 | 0.7 | 70.1 | 0.6 | 71.1 |
| 65 | 0.8 | 71.8 | 0.7 | 72.4 |
| 70 | 0.9 | 73 | 0.9 | 73.9 |
| 75 | 1.1 | 74.5 | 1.9 | 74.9 |
| 80 | 1.2 | 75.4 | 1.1 | 76.3 |
| 85 | 1.4 | 76.4 | 1.2 | 77 |
| 90 | 1.5 | 77.4 | 1.3 | 78.1 |
| 95 | 1.7 | 78.5 | 1.5 | 78.5 |

| | 118 Holes 3/16" Dia. 2" Thick | | 1060 Holes 1/16" Dia. 2" Thick | |
|---|---|---|---|---|
| Flow Rate (scfm) | Pressure (Inches of $H_2O$) | SPL (dBA) | Pressure (Inches of $H_2O$) | SPL (dBA) |
| 5 | 0 | 51.6 | 0.1 | 30 |
| 10 | 0 | 57.5 | 0.1 | 52.9 |
| 15 | 0.1 | 57.8 | 0.2 | 55 |
| 20 | 0.1 | 59.2 | 0.3 | 56.6 |
| 25 | 0.2 | 61.4 | 0.4 | 58.1 |
| 30 | 0.2 | 63.1 | 0.5 | 39.8 |
| 35 | 0.3 | 64.7 | 0.5 | 61.7 |

TABLE II-continued

| | | | | |
|---|---|---|---|---|
| 40 | 0.4 | 66.2 | 0.7 | 62.9 |
| 45 | 0.4 | 67.9 | 0.8 | 64.5 |
| 50 | 0.5 | 68.8 | 0.9 | 65.7 |
| 55 | 0.6 | 70.6 | 1.1 | 67.1 |
| 60 | 0.7 | 71.5 | 1.3 | 68.9 |
| 65 | 0.7 | 73 | 1.4 | 70 |
| 70 | 0.9 | 73.9 | 1.6 | 71.3 |
| 75 | 1 | 75.5 | 1.8 | 72.5 |
| 80 | 1.1 | 76.5 | 1.9 | 73.5 |
| 85 | 1.3 | 77.3 | 2.1 | 74.9 |
| 90 | 1.4 | 78 | 2.3 | 75.3 |
| 95 | 1.6 | 79.4 | 2.6 | 76.4 |

It can be seen from the data that when the percent open area was held constant, smaller numbers of larger holes and associated changes in wall surface area and length to diameter ratios led to lower back pressures and higher noise levels. Conversely, larger numbers of smaller holes and associated changes provided for increased noise attenuation but with greater back pressure.

EXAMPLE 4

This Example showed the effect of varying the through hole(s) patterns.

In this Example, the ACM-1 barrier material as prepared in Example 1 was used. Three 2 inch thick samples were made and 144 through holes having a 1/8 inch diameter were drilled into them, each having a different pattern. The patterns were the evenly spaced array (grid pattern) of Example 1, a series of corner to corner relatively evenly spaced holes in a double rowed (3/8 inch row spacing) "X" pattern (X), centered on the sample, and 2 concentric circles (circle) of diameters of 4¾" and 10½" respectively, from relatively evenly spaced holes. The samples were then tested for SPL and BP.

Test results along with the flow rate is given in Table III.

TABLE III

| | 144 1/8" Holes 2" Thick Varied Hole Patterns | | | | | |
|---|---|---|---|---|---|---|
| | Grid Pattern | | X-Pattern | | Concentric Pattern (2 Circles) | |
| Flow Rate (scfm) | Pressure (Inches of $H_2O$) | SPL (dBA) | Pressure (Inches of $H_2O$) | SPL (dBA) | Pressure (Inches of $H_2O$) | SPL (dBA) |
| 5 | 0.1 | 50.3 | 0.3 | 0.3 | 0.1 | 50.3 |
| 10 | 0.1 | 53.3 | 0.1 | 55.7 | 0.1 | 55.2 |
| 15 | 0.2 | 54.7 | 0.2 | 57.3 | 0.2 | 55.9 |
| 20 | 0.4 | 55.8 | 0.3 | 59 | 0.3 | 57.5 |
| 25 | 0.6 | 57.2 | 0.5 | 61 | 0.5 | 59.1 |
| 30 | 0.7 | 59.1 | 0.6 | 62.6 | 0.6 | 60.8 |
| 35 | 1 | 60.9 | 0.9 | 64.2 | 0.8 | 62.9 |
| 40 | 1.3 | 62.4 | 1.1 | 65.7 | 1 | 64.1 |
| 45 | 1.6 | 63.7 | 1.4 | 66.8 | 1.3 | 65.9 |
| 50 | 2 | 65 | 1.7 | 68 | 1.6 | 66.5 |
| 55 | 2.5 | 66.7 | 2.1 | 69.2 | 2 | 68.4 |
| 60 | 2.9 | 67.9 | 2.5 | 70.6 | 2.4 | 69.1 |
| 65 | 3.4 | 69.1 | 2.9 | 71.8 | 2.8 | 70.5 |
| 70 | 4 | 70.4 | 3.3 | 72.9 | 3.2 | 70.2 |
| 75 | 4.6 | 71.6 | 3.8 | 74.3 | 3.7 | 73 |
| 80 | 5.1 | 72.7 | 4.3 | 75.1 | 4.2 | 74.4 |
| 85 | 5.7 | 73.6 | 4.8 | 76.2 | 4.7 | 75.1 |
| 90 | 6.4 | 74.5 | 5.3 | 77 | 5.1 | 75.7 |
| 95 | 7.2 | 75.7 | 6.1 | 78.4 | 5.8 | 76.9 |

From the data it can be seen that the through hole pattern has an effect on the sound performance and back pressure of the attenuator.

EXAMPLE 5

In this Example, various types of porous materials were used.

The porous materials used were ACM-1, prepared according to Example 1 and porous polyethylene (commercially available under the trade designation "Porex X-4930" from Porex Technologies, Fairburn, Ga.). The "Porex X-4930" had a density of 31.9 lb/ft$^3$, a Young's modulus of 31,200 psi, and would have a pore diameter of about 10 micrometers to about 40 micrometers. The 12 inch by 12 inch by 0.24 inch thick sample weighed 290 grams. The ACM-1 sample was 0.25 inch thick. Both samples had 144 through holes of ⅛ inch diameter drilled in them in the grid pattern of Examples 1 and 4. The samples were tested as in Example 1 for SPL and BP. Test results and AFR are given in Table IV below.

TABLE IV

| Flow | X-4930 W/144⅛" Holes | | .25" ACM-1 W/144⅛" Holes | |
|---|---|---|---|---|
| Rate (scfm) | Pressure (inches of $H_2O$) | SPL (dBA) | Pressure (inches of $H_2O$) | SPL (dBA) |
| 5 | 0 | 55.9 | 0 | 56.5 |
| 10 | 0.1 | 61.5 | 0 | 61 |
| 15 | 0.2 | 64.7 | 0 | 64.3 |
| 20 | 0.3 | 66.1 | 0.1 | 66.1 |
| 25 | 0.4 | 68.6 | 0.2 | 67.8 |
| 30 | 0.5 | 69.8 | 0.2 | 70.1 |
| 35 | 0.6 | 71.4 | 0.5 | 71.5 |
| 40 | 0.8 | 72.7 | 0.4 | 73.3 |
| 45 | 1 | 73.8 | 0.5 | 75 |
| 50 | 1.2 | 74.7 | 0.6 | 75.8 |
| 55 | 1.4 | 76 | 0.7 | 77.2 |
| 60 | 1.6 | 77.1 | 0.8 | 78.1 |
| 65 | 1.8 | 78.6 | 1 | 79.5 |
| 70 | 2.1 | 80.1 | 1.1 | 80.9 |
| 75 | 2.3 | 80.9 | 1.2 | 81.9 |
| 80 | 2.6 | 82.3 | 1.4 | 82.8 |
| 85 | 2.8 | 83.1 | 1.5 | 83.6 |
| 90 | 3 | 84.2 | 1.7 | 84.5 |
| 95 | 3.4 | 85.4 | 1.9 | 85.8 |

EXAMPLE 6

In this Example, another type of porous material was used to prepare an attenuator of the invention. A comparative attenuator was prepared from a non-porous material.

The porous material, designated ACM-2, was prepared according to Example 1 except that aluminosilicate spheres (commercially available under the trade designation "Z-Light W1600" from Zeelan Industries, St. Paul, Minn.) were used in place of the K15 glass bubbles and the type 265 epoxy resin was blended with the Z-Light W1600 in a 1:6 by weight resin to particle ratio. The resulting block was 12¾ inches by 12¾ inches. The ACM-2 had a density of 28.8 lb/ft$^3$, Young's modulus of 218,000 psi, and a % porosity of about 35%. The non-porous material was aluminum which had a density of about 171 lb/ft$^3$. Both samples were ½ inch thick and had 144 through holes of ⅛ inch diameter drilled through them in the grid pattern of Examples 1 and 4. The samples were tested as in Example 1 for SPL and BP.

Test results and flow rate are given in Table V below.

TABLE V

| | ACM-2 144⅛" Holes | | Aluminum 144⅛" Holes | |
|---|---|---|---|---|
| Flow Rate (scfm) | Pressure (inches of $H_2O$) | SPL (dBA) | Pressure (inches of $H_2O$) | SPL (dBA) |
| 5 | 0 | 52.4 | 0 | 51.6 |
| 10 | 0.1 | 57 | 0 | 55.3 |
| 15 | 0.1 | 59.3 | 0.1 | 58.6 |
| 20 | 0.2 | 61.1 | 0.2 | 59.9 |
| 25 | 0.4 | 63.5 | 0.3 | 62.4 |
| 30 | 0.5 | 65.3 | 0.5 | 64.7 |
| 35 | 0.6 | 66.9 | 0.6 | 65.9 |
| 40 | 0.7 | 68.5 | 0.7 | 67.9 |
| 45 | 0.9 | 70.3 | 0.9 | 69.9 |
| 50 | 1.1 | 71.1 | 1.1 | 70.7 |

TABLE V-continued

| | ACM-2 144⅛" Holes | | Aluminum 144⅛" Holes | |
|---|---|---|---|---|
| Flow Rate (scfm) | Pressure (inches of $H_2O$) | SPL (dBA) | Pressure (inches of $H_2O$) | SPL (dBA) |
| 55 | 1.3 | 72.5 | 1.3 | 72.7 |
| 60 | 1.5 | 73.6 | 1.6 | 73.3 |
| 65 | 1.7 | 75.1 | 1.8 | 74.5 |
| 70 | 1.9 | 76.4 | 2.1 | 75.6 |
| 75 | 2.1 | 77.6 | 2.4 | 76.9 |
| 80 | 2.4 | 79.6 | 2.6 | 78.1 |
| 85 | 2.6 | 79.6 | 2.9 | 78.8 |
| 90 | 2.9 | 80.5 | 3.3 | 79.9 |
| 95 | 3.2 | 81.3 | 3.5 | 80.3 |

From the table it can be seen that the sound performance of aluminum and the attenuator of the invention are comparable which is not expected on a mass law basis. Additionally, the attenuator of the invention has lower back pressure.

EXAMPLE 7

In this Example, a porous material was used to prepare an attenuator of the invention and compared to a comparative attenuator prepared from a non-porous material.

The porous material used was ACM-1, prepared according to Example 1. The non-porous material was particle board. All samples were ¾ inch thick and had 265 through holes of ⅛ inch diameter drilled in them in the grid pattern of Examples 1 and 4. The weight of the ACM-1 sample was 506.2 grams and the weight of the particle board was 1,525.9 grams. The samples were tested as in Example 1 for SPL and BP. Insertion loss was measured according to the following: the sound pressure level was measured according to Example 1 with no sample in place, i.e., an open box. Then the sound pressure level was measured with the sample in place in the holder. The difference between the sound pressure level for no sample and the sound pressure level with sample in place was the insertion loss.

Test results and flow rate are given in Table VI below.

TABLE VI

| | Particle Board - ¾" Thick with 265 Holes | | ACM-1 - ¾" Thick with 265 Holes | |
|---|---|---|---|---|
| Flow Rate (scfm) | Pressure (Inches of $H_2O$) | Insertion Loss (dBA) | Pressure (Inches of $H_2O$) | Insertion Loss (dBA) |
| 5 | 0.60 | 13.3 | 0.45 | 12.9 |
| 10 | 0.70 | 15.6 | 0.60 | 13.3 |
| 15 | 0.70 | 14.1 | 0.65 | 14.2 |
| 20 | 0.75 | 16.4 | 0.75 | 16.3 |
| 25 | 0.75 | 16.5 | 0.75 | 16.5 |
| 30 | 0.80 | 17.0 | 0.75 | 16.6 |
| 35 | 0.95 | 16.9 | 0.80 | 16.7 |
| 40 | 1.10 | 17.3 | 0.85 | 16.4 |
| 45 | 1.15 | 18.2 | 0.95 | 18.0 |
| 50 | 1.20 | 19.1 | 1.10 | 19.0 |
| 55 | 1.45 | 17.3 | 1.20 | 17.3 |
| 60 | 1.70 | 17.6 | 1.20 | 17.3 |
| 65 | 1.75 | 17.3 | 1.40 | 15.8 |
| 70 | 1.85 | 17.2 | 1.50 | 16.8 |
| 75 | 2.15 | 16.9 | 1.60 | 16.8 |
| 80 | 2.40 | 17.1 | 1.75 | 16.9 |
| 85 | 2.50 | 16.2 | 1.85 | 16.3 |
| 90 | 2.70 | 17.1 | 2.10 | 16.2 |
| 95 | 2.80 | 17.3 | 2.20 | 16.9 |

TABLE VI-continued

| Flow Rate (scfm) | Particle Board - ¾" Thick with 265 Holes | | ACM-1 - ¾" Thick with 265 Holes | |
|---|---|---|---|---|
| | Pressure (Inches of $H_2O$) | Insertion Loss (dBA) | Pressure (Inches of $H_2O$) | Insertion Loss (dBA) |
| 100 | 3.15 | 17.3 | 2.40 | 15.8 |

From the table it can be seen that the attenuator of the invention provides better overall sound performance by providing comparable insertion loss values and better back pressure performance with less mass when compared to particle board. This data along with that from Example 6 shows that the porous material shows a pressure drop benefit when the hole length is greater than about ½ inch.

EXAMPLE 8

In this Example, a porous barrier material of varying thickness and number of through holes was used to prepare an attenuator.

The porous materials used was ACM-1, prepared according to Example 1 in varying thicknesses. A plurality of ⅛ inch diameter holes was drilled in each sample in the grid pattern of Examples 1 and 4. The samples were tested as in Example 1 for SPL and BP.

Each sample was tested over the air flow range of 5 to 100 scfm and the differences in SPL and BP among the samples were approximately the same over the range of 20–100 scfm. Test results for 60 scfm air flow are given in Table VII below.

TABLE VII

| Thickness (Inches) | 1.23% Open Area 144 Holes | | 2.26% Open Area 263 Holes | | 5.34% Open Area 625 Holes | |
|---|---|---|---|---|---|---|
| | Pressure (Inches $H_2O$) | SPL (dBA) | Pressure (Inches $H_2O$) | SPL (dBA) | Pressure (Inches $H_2O$) | SPL (dBA) |
| 1 | 2.919 | 71.8 | 1.047 | 75.4 | 0.804 | 80.1 |
| 2 | 3.933 | 68.9 | 1.48 | 71.4 | 0.804 | 75.5 |
| 4 | 4.864 | 65.9 | 1.819 | 66.7 | 0.888 | 70.4 |
| 6 | 5.202 | 65.1 | 1.903 | 66.3 | 0.888 | 68.5 |

From the table it can be seen that the attenuator of the invention shows the following trends with regard to sample thickness, number of holes, and percent open area. As thickness of the sample increases, both back pressure and sound attenuation increase. As number of holes and the percent open area increases, back pressure and sound attenuation decrease.

EXAMPLE 9

In this example, the sound performance of an attenuator made from porous material with varying number of through holes versus frequency was determined.

The porous material used was ACM-1, prepared according to Example 1. Three samples of 6 inch thickness were prepared and drilled with 144, 265 or 625 through holes of ⅛ inch diameter, in the grid pattern of Examples 1 and 4.

Each of the samples was tested for SPL as outlined in Example 1 except that frequency in Hertz was measured instead of air flow rate.

SPL values and frequency are given in Table VIII below.

TABLE VIII

| Frequency (Hz) | 144 Holes | 265 Holes | 625 Holes |
|---|---|---|---|
| 31.5 | 18.27 | 18.46 | 23.54 |
| 40 | 22.34 | 20.48 | 24.74 |
| 50 | 22.91 | 23.33 | 19.92 |
| 63 | 31.96 | 32.43 | 29.84 |
| 80 | 25.59 | 25.05 | 24.46 |
| 100 | 24.39 | 24.04 | 25.07 |
| 125 | 29.61 | 29.00 | 28.64 |
| 160 | 33.18 | 33.89 | 33.32 |
| 200 | 38.59 | 38.17 | 39.22 |
| 250 | 42.92 | 45.15 | 49.65 |
| 315 | 41.98 | 44.9 | 50.63 |
| 400 | 41.53 | 44.14 | 48.75 |
| 500 | 55.01 | 59.71 | 64.86 |
| 630 | 51.36 | 51.83 | 57.83 |
| 800 | 55.43 | 57.01 | 59.34 |
| 1000 | 47.53 | 47.95 | 51.57 |
| 1250 | 52.40 | 54.00 | 55.93 |
| 1600 | 49.98 | 52.77 | 54.16 |
| 2000 | 51.27 | 50.89 | 50.99 |
| 2500 | 51.88 | 52.80 | 53.81 |
| 3150 | 50.99 | 50.87 | 52.88 |
| 4000 | 50.82 | 50.12 | 49.91 |
| 5000 | 53.83 | 53.57 | 52.96 |
| 6300 | 56.65 | 65.21 | 55.41 |
| 8000 | 57.38 | 56.73 | 55.69 |
| 10000 | 52.63 | 52.75 | 51.43 |

These data show the unexpected affect of greater noise attenuation at frequencies 4000 Hertz and above with increasing number of holes.

Loudspeaker Example

A loudspeaker cabinet was constructed from the attenuator of the invention. In the case of a loudspeaker cabinet the combined electrical, mechanical and pneumatic interactions resulted in a resonant magnification and redirection of sound. The cabinet was constructed of the same type of material as ACM-1 (prepared according to Example 1) with one inch thickness, mass of 3.97 kilograms and one inch hole spacing. The holes on the top were in an array 8×13, on the sides 8×19 and on the back 13×19.

The cabinet interior dimension, was 13"×19"×8". All through holes were ⅛" in diameter. The loudspeaker cone used was an Audio Concepts type AC8, LaCrosse, Wis. Its direct current impedance was 4.8 Ohms.

Two types of test were performed on the cabinet: off-axis simulated free field response tests and impedance tests.

Off-axis simulated free field response is termed the horizontal polar response. Polar response measurements were made for 45 degree increments in azimuth around the cabinet at angles normal to the front of the cabinet of 0, 45, 90, 135 and 180 degrees (deg). Acoustic responses were made in ⅓ octave bands with center frequencies starting at 20 Hertz and ending at 20000 Hertz. A Bruel and Kjaer 2144 real time analyzer was used with input from a Bruel and Kjaer 4135 microphone. Data was collected with the microphone in the horizontal plane of the center of the loudspeaker cone and one meter distant from it. A Bruel and Kjaer 1402 pink noise source was used as a sound source. Pink noise is defined as noise having equal energy in each ⅓ octave band of interest. The pink noise was amplified by a Crown Com-Tech 800 before being fed into the loudspeaker. Testing was performed in an anechoic chamber.

Impedance data was collected for the same cabinet. Impedance is the combined effect of a speaker's electrical resistance, inductance and capacitance opposing an input signal. It varies with frequency and is measured in ohms. The Audio Concepts type AC8 loudspeaker was used. A Bruel and Kjaer WB1314 noise source generator was used to drive the loudspeaker. A 1000 Ohm resistor in series with the loudspeaker created a constant current circuit and the frequency response voltage across the loudspeaker terminals was measured with a Bruel and Kjaer 2148 dual channel analyzer from zero to 400 Hertz in ½ Hertz steps. A calibration was carried out with a 10 Ohm resistor replacing the series combination of 1000 Ohm resistor plus loudspeaker. The loudspeaker response in free air was measured. Then the loudspeaker was mounted in the loudspeaker cabinet and the cabinet's response was measured.

The resonant frequency for the loudspeaker in free air was at 33.5 Hertz while the cabinet resonated at 30.5 Hertz. The cabinet resonance was shifted down in frequency from the free air case because the holes yielded a dynamic mass increase, which lowered the resonant frequency. The net effect of having holes in the cabinet was to produce a particular type of ported or vented loudspeaker cabinet.

While this invention has been described in terms of specific embodiments it should be understood that it is capable of further modification. The claims herein are intended to cover those variations one skilled in the art would recognize as the equivalent of what has been done.

We claim:

1. An acoustical attenuator comprising:

a porous material comprised of particles sintered and/or bonded together at their points of contact, having at least a portion of pores continuously connected, wherein said porous material has an interstitial porosity of about 20 to about 60 percent, an average pore diameter of about 5 to about 280 micrometers, a tortuosity of about 1.25 to about 2.5, a density of about 5 to about 60 pounds per cubic foot, a modulus of about 12,000 pounds per square inch or above, wherein said porous material has at least one through hole and wherein said interstitial porosity, average pore diameter, density and modulus values are for the porous material in the absence of any through holes, wherein the average diameter of the through hole is greater than the average pore diameter.

2. The attenuator of claim 1, wherein said through hole(s) have an average length of about ⅛ inch or greater.

3. The attenuator of claim 2, wherein said through hole(s) have an average length of about ½ inch or greater.

4. The attenuator of claim 1, wherein said through hole(s) have an average diameter of about 1/64 inch to about 6 inches.

5. The attenuator of claim 4, wherein said through hole(s) have an average diameter of about 1/16 inch to about 2 inches.

6. The attenuator of claim 1, wherein about 0.1 to about 90 percent of the surface area of the attenuator contains through hole(s).

7. The attenuator of claim 1, wherein said through holes are in a symmetrical pattern.

8. The attenuator of claim 1, wherein said through hole(s) cross-section has a shape selected from the group consisting of circular, rectangular, triangular, elliptical, square and slit shaped.

9. The attenuator of claim 1, wherein said through hole(s) are in an asymmetrical pattern.

10. The attenuator of claim 1, wherein the average length to diameter ratio of the through hole(s) ranges from about 1:1 to about 100:1.

11. The attenuator of claim 1 wherein said porous material has a average thickness of about 1/64 inch or greater.

12. The attenuator of claim 1 wherein said material has an average thickness of about ½ inch or greater.

13. The attenuator of claim 1 wherein the porous material contains a plurality of through holes.

14. An acoustical system comprising a sound source and an attenuator, the attenuator comprising:

a porous material comprised of particles sintered and/or bonded together at their points of contact, having at least a portion of pores continuously connected, wherein said porous material has an interstitial porosity of about 20 to about 60 percent, an average pore diameter of about 5 to about 280 micrometers, a tortuosity of about 1.25 to about 2.5, a density of about 5 to about 60 pounds per cubic foot, a modulus of about 12,000 pounds per square inch or above, wherein said porous material has at least one through hole and wherein said interstitial porosity, average pore diameter, density and modulus values are for the porous material in absence of any through holes, wherein the average diameter of the through hole is greater than the average pore diameter.

15. The acoustical system of claim 14 wherein the sound source is a loudspeaker and the attenuator is a loudspeaker cabinet or loudspeaker housing.

16. A method of of attenuating sound comprising the step of using an acoustical attenuator within an ambient medium, said acoustical attenuator comprising a porous material comprised of particles sintered and/or bonded together at their points of contact, having at least a portion of pores continuously connected, wherein said porous material has an interstitial porosity of about 20 to about 60 percent, an average pore diameter of about 5 to about 280 micrometers, a tortuosity of about 1.25 to about 2.5, a density of about 5 to about 60 pounds per cubic foot, a modulus of about 12,000 pounds per square inch or above, wherein said porous material has at least one through hole and wherein said interstitial porosity, average pore diameter, density and modulus values are for the porous acoustical material in the absence of any through holes, wherein the average diameter of the through hole is greater than the average pore diameter.

17. The attenuator of claim 1, wherein about 0.5 to about 50 percent of the surface area of the attenuator contains through holes(s).

18. The attenuator of claim 1, wherein about 0.9 to about 25 percent of the surface area of the attenuator contains through hole(s).

* * * * *